United States Patent [19]

Caprari

[11] 4,243,917

[45] Jan. 6, 1981

[54] FLASH LAMP DRIVE CIRCUIT

[75] Inventor: Fausto Caprari, East Brunswick, N.J.

[73] Assignee: RCA Corporation, New York, N.Y.

[21] Appl. No.: 11,558

[22] Filed: Feb. 12, 1979

[51] Int. Cl.[3] ..... H05B 41/34

[52] U.S. Cl. ..... 315/241 R; 315/200 A; 315/240; 320/1; 340/331

[58] Field of Search ..... 315/200 A, 240, 241 R, 315/241 S, 360; 320/1; 340/331, 333

[56] References Cited

U.S. PATENT DOCUMENTS

| | | | |
|---|---|---|---|
| 3,525,016 | 8/1970 | Caprari | 315/241 R |
| 3,560,842 | 2/1971 | Caprari | 320/1 X |
| 3,953,763 | 4/1976 | Herrick | 315/241 S X |
| 4,103,298 | 7/1978 | Redding | 340/331 |

*Primary Examiner*—Eugene R. LaRoche
*Attorney, Agent, or Firm*—E. M. Whitacre; P. J. Rasmussen; John M. O'Meara

[57] ABSTRACT

The life expectancy of the energy storing capacitors in a flash lamp drive circuit is extended by charging them in response to a trigger signal which also initiates the ionization pulse to the lamp after a delay time so that a desired threshold of energy stored in the capacitors is directed to the lamp.

6 Claims, 1 Drawing Figure

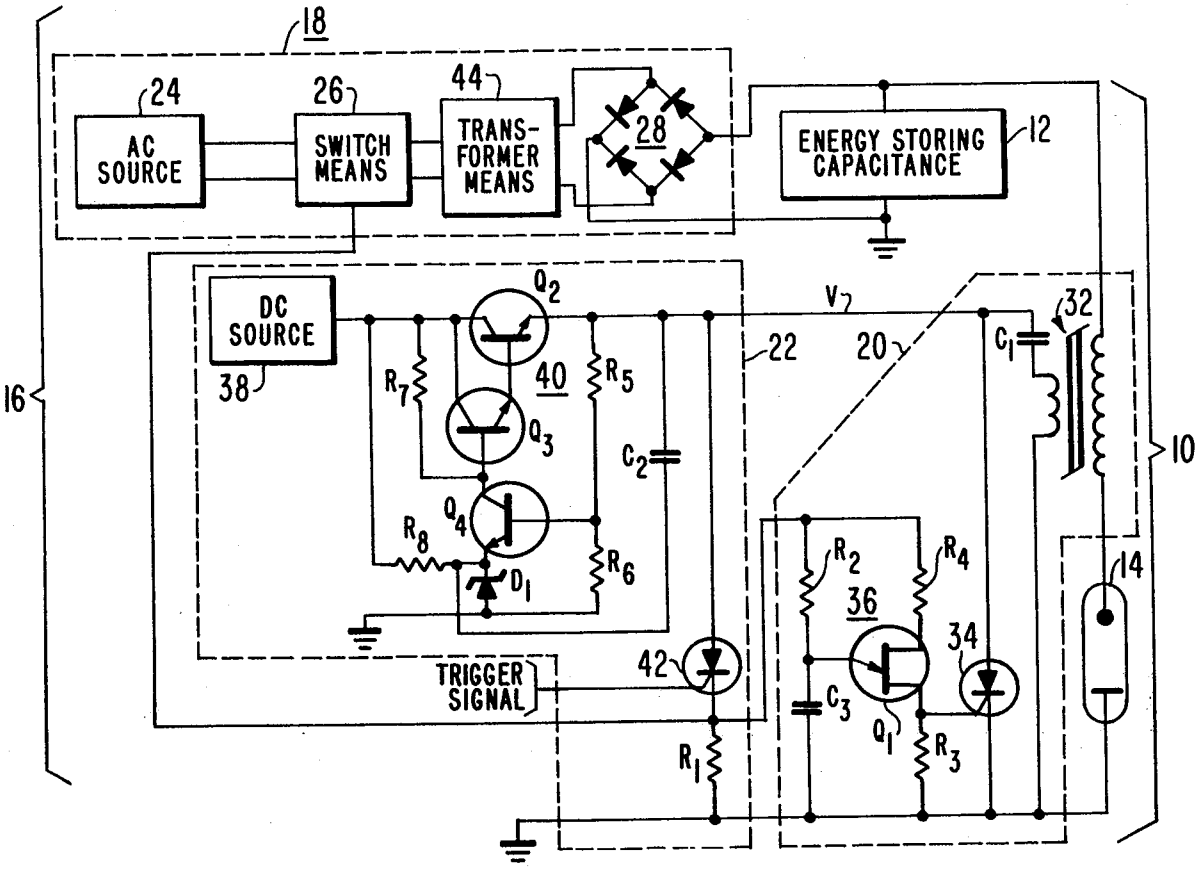
10
14
32
12
ENERGY STORING CAPACITANCE
$C_1$
$R_4$
34
$R_3$
20
$V_7$
$R_2$
36
$Q_1$
$C_3$
22
42
$R_1$
28
$C_2$
$R_5$
$R_6$
$Q_2$
40
$Q_3$
$Q_4$
$D_1$
TRIGGER SIGNAL
44
TRANS-FORMER MEANS
$R_7$
$R_8$
26
SWITCH MEANS
18
DC SOURCE
38
24
AC SOURCE
16

FLASH LAMP DRIVE CIRCUIT

The present invention relates to a flash lamp drive circuit of the type wherein energy is stored by a capacitance and supplied to the lamp when an ionization pulse is applied thereto.

Although flash lamp drive circuits of this type are known in the art, high energy must be supplied by the capacitance in such drive circuits when high intensity ultraviolet radiation is to be generated by the lamp. Known drive circuits accomplish this by first charging the capacitance to a high voltage level and at some later time applying an ionization pulse to the lamp which then draws the stored energy from the capacitance. The high voltage capacitors which must be utilized in such high intensity ultraviolet applications are expensive and have a shortened life expectancy due to the length of the energy storage duration encountered in prior art flash drive circuits. Therefore, such circuits require continual attention and their maintenance costs are very high.

The flash lamp drive circuit of this invention extends the life expectancy of the high voltage capacitors in its energy storing capacitance by charging them to a threshold energy level in response to a trigger signal and by applying the ionization pulse to the lamp to discharge that capacitance therethrough when the stored energy level reaches a desired threshold. This circuit considerably shortens the period for which the high voltage capacitors must store energy. In one preferred embodiment, a power supply means for selectively charging the capacitance to store energy therein and a delay means for applying the ionization pulse to the lamp are simultaneously activated by the trigger signal. After some predetermined delay time, the ionization pulse is applied when the threshold energy level has been stored in the capacitance. A reset means for inactivating both the power supply means and the delay means after each trigger signal is also included in this embodiment.

In the drawing, a block diagram of the invention is illustrated in the sole FIGURE, and a schematic diagram of the preferred embodiments is also incorporated therein.

In the sole FIGURE, a flash drive circuit 10 is shown of the type wherein energy is stored in a capacitance 12 and supplied to a Xenon lamp 14 when an ionization pulse is applied thereto. Flash drive circuit 10 also includes a control means 16 for charging the capacitance 12 to a threshold energy level in response to a trigger signal and for applying an ionization pulse to the lamp 14 to discharge the capacitance 12 therethrough when the threshold energy level is reached. Capacitance 12 may include any number of capacitors connected in any electrical arrangement that is suitable to the required threshold energy level, such as a voltage multiplying arrangement. The flash occurs while the energy stored in capacitance 12 is being discharged through the lamp 14 and the capacitance 12 remains discharged thereafter until another trigger signal is applied. Consequently, energy is only stored in the capacitance 12 during each flash cycle for the time between when the trigger signal is applied and when the threshold energy level is reached. Therefore, the energy storage duration encountered by the capacitance 12 in the flash drive circuit 10 is essentially minimized.

Although many embodiments of the control means 16 are possible, the block diagram of one preferred embodiment thereof is illustrated in the sole FIGURE where the trigger signal simultaneously activates a power supply means 18 for selectively charging the capacitance 12 to store energy therein and a delay means 20 for applying an ionization pulse to the lamp 14 at some predetermined time subsequent to the trigger signal. This embodiment also includes a reset means 22 for inactivating both the power supply means 18 and the delay means 20 after each trigger signal is applied. Because the power supply means 18 and the delay means 20 are simultaneously activated, charge is stored in the capacitance 12 for the delay time that elapses prior to when the ionization pulse is applied. Consequently, the threshold energy level that is supplied to the lamp 14 by the capacitance 12 is directly proportional to that delay time. Furthermore, the power supply means 18 and the delay means 20 are inactivated after the trigger signal has been applied, so that the lamp 14 could be continuously flashed at a frequency having a period substantially equal to the delay time.

Although many embodiments of the invention are possible in regard to the power supply means 18, the delay means 20 and the reset means 22, schematic diagrams for particular embodiments of these elements are shown in the sole FIGURE. Within the power supply means 18, an AC source 24 is connected through a switch means 26 for selectively controlling current flow in response to the trigger signal and applied to a rectifier means 28 for converting AC to DC. The output terminals of the rectifier means 28 are connected across the capacitance 12. Within the delay means 20, the secondary winding of a transformer 32 is disposed to direct stored energy from the capacitance 12 through the lamp 14 to a reference voltage rail such as ground, while the primary winding thereof has one side connected to ground and the other side connected to a voltage rail V through a capacitor $C_1$. Also connected between the rail V and ground is the main conduction path of an SCR 34 having its gate electrode connected through a relaxation oscillator 36 to respond to the trigger signal. Within the reset means 22, a DC source 38 is applied to the rail V through a series regulator 40 and a capacitor $C_2$ is connected between the rail V and a reference voltage input of the series regulator 40. Also connected between the rail V and ground is a resistor $R_1$ in series with the main conduction path of an SCR 42 having its gate electrode connected to the trigger signal. The input to both the switch means 26 in the power supply means 18 and the relaxation oscillator 36 in the delay means 20 are connected between $R_1$ and the SCR 42 to respond to the trigger signal.

Power supply means 18 is activated when switch means 26 is rendered conductive by the trigger signal to pass alternating current from source 24 to rectifier means 28 and charge is then applied to the capacitance 12 so that energy is stored therein. Delay means 20 is activated when relaxation oscillator 36 is energized by the trigger signal to render SCR 34 conductive during its first cycle of operation. $C_1$ is then discharged through SCR 34 to cause current flow in the primary winding of transformer 32, responsive to which the ionization pulse for the lamp 14 is thereby induced in the secondary winding of transformer 32. Power supply means 18 and delay means 20 are activated simultaneously by the voltage change that occurs across $R_1$ when the trigger signal is applied to render SCR 42 conductive within the reset means 22. The level of rail V is developed within the reset means 22 from the source 38 through the operation of the series regulator 40 and $C_2$ within the reset means 22 is discharged simultaneously with $C_1$ when SCR 34 becomes conductive within the delay means 20 to load down the rail V. Conduction through the series regulator 40 is terminated when the discharge pulse of $C_2$ is applied to the reference voltage input thereof and holding current is then no longer maintained through the SCR's 34 and 42 which become nonconductive. Although conduction through the series regulator 40 resumes immediately thereafter to restore the level of the rail V and thereby recharge $C_1$ and $C_2$, SCR's 34 and 42 remain non-conductive. Therefore, the power supply means 18 and the delay means 20 are reset, in that they remain inactivated until the next trigger signal is applied to energize the relaxation oscillator 36 and to render the switch means 28 conductive. During this reset interval, capacitance 12 remains discharged to lessen the high voltage stress duration encountered by the capacitors therein.

It should be understood by those skilled in the art that many variations are possible in the circuitry of the power supply means 18, or the delay means 20, or the reset means 22. In the power supply means 18, a transformer means 44 for regulating the input voltage level of the rectifier means 28 could be utilized, which in one embodiment (not specifically shown) that has been reduced to practice included regulating, amplitude setting, and step-up stages. The switch means 26 could be of solid state construction and could be included in an integrated circuit along with digital circuitry for generating the trigger signal. Also, the rectifier means 28 could be of a conventional type such as the diode bridge which is shown in the sole FIGURE. Furthermore, a DC source (not shown) having predetermined output characteristics could be utilized to charge the capacitance 12 through the switching means 26 to thereby do away with both the AC source 24 and the rectifier means 28 in the sole FIGURE. In the delay means 20, the relaxation oscillator 36 would be of a conventional type such as that shown in the sole FIGURE where a unijunction transistor $Q_1$ having its emitter connected between a resistor $R_2$ and a capacitor $C_3$ which are series connected across $R_1$ in the reset means 22. The base-one and base-two of $Q_1$ are series connected across $R_1$ through resistors $R_3$ and $R_4$ respectively, while the oscillatory output is applied to the gate electrode of the SCR 34 from between $Q_1$ and $R_3$. Furthermore, the transformer 32 is shown to be a step-up type; however, this is not a requirement where the rail V is of sufficient magnitude. In the reset means 22, the series regulator 40 would be of a conventional type such as that shown in the sole FIGURE where bipolar transistors $Q_2$, $Q_3$ and $Q_4$ of the same conductivity type are disposed in a regulator circuit arrangement similar to that disclosed in the applicant's U.S. Pat. No. 3,560,842. $Q_2$ and $Q_3$ are connected in a Darlington arrangement which is driven through the main conduction path of $Q_4$. The base electrode of $Q_4$ is connected between resistors $R_5$ and $R_6$ which are series connected from the rail V to ground, while the base of $Q_3$ is connected to the rail V through a resistor $R_7$. Furthermore, the emitter electrode of $Q_4$ is connected between a resistor $R_8$ and a Zener diode $D_1$ which are series connected from the DC source 38 to ground. $C_2$ is connected from the rail V to the emitter electrode of $Q_4$ which is the reference voltage input whereat conductivity through the series regulator 40 is controlled. Also, the series regulator 40 could be driven from the AC source 24 within the power supply means 18 through a rectifier means (not shown) for converting AC to DC to thereby do away with the separate DC source 38. Furthermore, a resistor (not shown) could be connected between the rail V and the anode of the SCR 34 to facilitate turning that SCR off by limiting current flow therebetween. However, this resistor as well as $C_2$ could be replaced by another SCR in an embodiment (not specifically shown) that has been reduced to practice. The main conduction path of this SCR would be connected to shunt the reference voltage input of the regulator 40 to ground and its gate electrode would be connected through the relaxation oscillator 36 to respond to the trigger signal. This SCR assures termination of current flow through the SCR's 34 and 42 by terminating the output from the regulator 40 concurrently with SCR 34 being rendered conductive through the oscillator 36 by the trigger signal.

Consequently this invention has been disclosed herein by describing only a few embodiments thereof and numerous changes in the details of construction and the combination or arrangement of parts could be made in these described embodiments without departing from the true scope and spirit of the invention. Therefore, the present disclosure should be construed as illustrative rather than limiting.

What I claim is:

1. In a flash lamp drive circuit of the type wherein energy is stored by a capacitance and is supplied to the lamp when an ionization pulse is applied thereto, the improvement comprising:

control means for charging the capacitance to a threshold energy level in response to a trigger signal, and for applying the ionization pulse to the lamp to discharge the capacitance therethrough in response to and at some predetermined time after receiving said trigger signal, said control means so responding to each of said trigger signals applied thereto.

2. The drive circuit of claim 1 wherein said control means includes:

power supply means responsive to said trigger signal for selectively charging the capacitance to store energy therein;

delay means responsive to said trigger signal for applying the ionization pulse to the lamp at said predetermined time subsequent to said trigger signal, said threshold energy level being proportional to said predetermined time; and reset means for inactivating both said power supply means and said delay means after each said trigger signal.

3. The drive circuit of claim 2 wherein a source is applied to said power supply means through switch means for selectively controlling current flow in response to said trigger signal.

4. The drive circuit of claim 2 wherein said delay means applies the ionization pulse to the lamp through a transformer having primary and secondary windings, said primary winding being in series combination with a first capacitor, said series combination being disposed in parallel with the main conduction path of a first SCR between a voltage rail and ground, the gate of said first SCR having the output of a relaxation oscillator applied thereto, said relaxation oscillator having its input energized by said trigger signal, said secondary winding being disposed to supply the energy stored in the capacitance to the lamp, said first SCR being rendered conductive through said relaxation oscillator by said trigger signal to discharge said first capacitor and thereby cause current flow in said primary winding to induce the ionization pulse in said secondary winding.

5. The drive circuit of claim 4 wherein a series regulator in said reset means supplies said voltage rail from a source and said reset means further includes a second SCR having its main conduction path disposed in series with a resistor between said voltage rail and ground while said trigger signal is applied to the gate electrode thereof, said series regulator having its voltage reference input connected to said voltage rail through a second capacitor, said switch means of said power supply means and said relaxation oscillator of said delay means having their inputs connected between said resistor and said second SCR, said trigger signal rendering said second SCR conductive to change the voltage level at the input to said switch means of said power supply means and said relaxation oscillator of said delay means, said second capacitor being discharged simultaneously with said first capacitor to render said series regulator nonconductive and thereby interrupting said voltage rail to terminate conduction through said first and second SCR's which resets both the power supply means and the delay means.

6. The drive circuit of claim 4 wherein a series regulator in said reset means supplies said voltage rail from a source and said reset means further includes a second SCR having its main conduction path disposed in series with a resistor between said voltage rail and ground while said trigger signal is applied to the gate electrode thereof, said series regulator having its voltage reference input connected to ground through the main conduction path of a third SCR having the output of said relaxation oscillator applied to the gate electrode thereof, said switch means of said power supply means and said relaxation oscillator of said delay means having their inputs connected between said resistor and said second SCR, said trigger signal rendering said second SCR conductive to change the voltage level at the input to said switch means of said power supply means and said relaxation oscillator of said delay means, said third SCR being rendered conductive simultaneously with said first SCR to render said series regulator nonconductive and thereby interrupting said voltage rail to terminate conduction through said first and second SCR's which resets both the power supply means and the delay means.

* * * * *